United States Patent [19]

Wheeler et al.

[11] 3,973,630

[45] Aug. 10, 1976

[54] WASH-OUT TOOL AND METHOD OF USE THEREOF

[75] Inventors: Virgil C. Wheeler, Long Beach; Harry D. Sharrett, Van Nuys, both of Calif.

[73] Assignee: Seaboard Oil & Gas Co., Los Angeles, Calif.

[22] Filed: May 22, 1975

[21] Appl. No.: 580,013

[52] U.S. Cl. ..... 166/312; 166/314; 166/67; 166/105.3; 166/164

[51] Int. Cl.[2] ..... E21B 37/00; E21B 21/00

[58] Field of Search ..... 166/312, 313, 314, 315, 166/56, 67, 68, 70, 156, 105, 105.3, 158, 164, 202, 191

[56] References Cited

UNITED STATES PATENTS

| | | | |
|---|---|---|---|
| 2,073,126 | 3/1937 | Sweet | 166/164 X |
| 2,138,375 | 11/1938 | Grant | 166/164 X |
| 2,501,237 | 3/1950 | Sanders | 166/105.3 |
| 2,805,718 | 9/1957 | Tausch | 166/312 X |
| 3,020,958 | 2/1962 | Kenneday | 166/312 X |
| 3,064,580 | 11/1962 | Calvert et al. | 166/313 X |
| 3,302,722 | 2/1967 | Madeley, Sr. | 166/312 X |
| 3,892,274 | 7/1975 | Dill | 166/312 X |

*Primary Examiner*—Stephen J. Novosad
*Attorney, Agent, or Firm*—William W. Haefliger

[57] ABSTRACT

A standing valve wash-out tool comprises:

a. a vertically elongated tubular body, b. elastomer cup means on the body to engage a well tubing bore as the body travels lengthwise within said bore in response to fluid pressure exertion on the cup means exteriorly of the body, c. the body having a fluid pressure inlet above the cup means, there being a frangible plug within the body blocking fluid pressure flow downwardly through the body, and d. a seat on the body proximate the lower end thereof and sized to land on sand containing means, whereby application of sufficient fluid pressure within the body will rupture said plug and pass downwardly through the body and outwardly below said seat to wash sand from said sand containing means.

13 Claims, 14 Drawing Figures

WASH-OUT TOOL AND METHOD OF USE THEREOF

BACKGROUND OF THE INVENTION

This invention relates generally to the servicing of wells, and more particularly concerns wash-out of sand that tends to collect in sub-surface equipment such as standing valves.

Standing valves are typically connected in series with sub-surface well tubing to cooperate with pumping units landed on such valves. For example, a pumping unit may be traveled downwardly in the tubing to land on a standing valve, and operated in response to pressure fluid supply to the unit, for drawing well production fluid upwardly through the valve. A problem that arises concerns the collection of sand in the standing valve, as a result of upward flow of well production fluid in which the sand is entrained. In the past, the tubing was pulled to retrieve the standing valve for removal of sand; however, this technique is expensive and time consuming. No method or apparatus of which we are aware possesses the unusual advantages in structure, function and results which are now afforded by the present invention, toward overcoming the above described problems.

SUMMARY OF THE INVENTION

Basically, the present invention concerns method and apparatus for removing sand from the standing valve, without requiring retrieval of the valve, through use of an unusually advantageous wash-out tool. As will be seen, the tool comprises:

a. a vertically elongated tubular body, b. elastomer cup means on the body to engage a well tubing bore as the body travels lengthwise within said bore in response to fluid pressure exertion on the cup means exteriorly of the body, c. the body having a fluid pressure inlet above the cup means, there being a frangible plug or disc within the body blocking fluid pressure flow downwardly through the body, and d. a seat on the body proximate the lower end thereof and sized to land on sand containing means, whereby application of sufficient fluid pressure within the body will rupture the disc and pass downwardly through the body and outwardly below the seat to wash sand from the sand containing means.

Typically, the tool body includes a reduced cross-section lower tubular projection, which may be provided with exterior flats, and which is downwardly received into the standing valve, the projection delivering pressure fluid to the interior of the valve to entrain sand, the latter then escaping upwardly out of the valve via clearances formed between the stem and valve bore; further, auxiliary tubing receives the flushed sand to conduct same to the surface. In addition, the cup means may include body upwardly and downwardly facing cups to enable fluid pressure driven travel of the tool both downwardly and upwardly in the tubing, and a projection at the top of the tool may be gripped by a wire-line suspended retrieval means to retrieve the tool by wire-line as may be desired. A flow responsive control valve may be carried by the tool body to pass inward flow into the body via the upper inlet, and to block outward flow from within the body, enabling pressure fluid driven upward travel of the tool.

These and other objects and advantages of the invention, as well as the details of an illustrative embodiment, will be more fully understood from the following description and drawings, in which:

DRAWING DESCRIPTION

FIG. 1 is a vertical elevation showing a well installation with a pumping unit therein cooperating in its operation with a standing valve;

FIGS. 2*a* and 2*b* are enlarged vertical sections showing the pump and valve in greater detail;

Figure 5A:
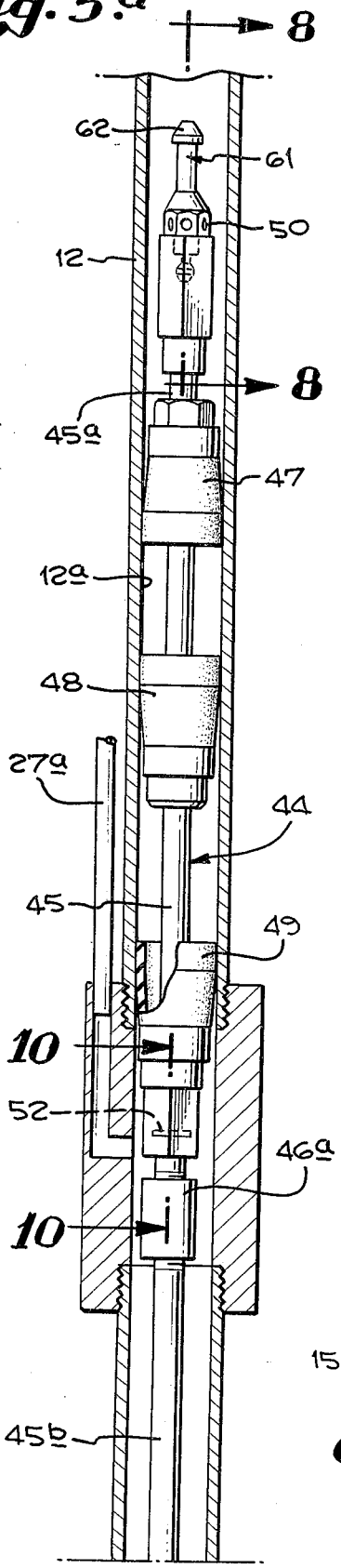
Figure 5B:
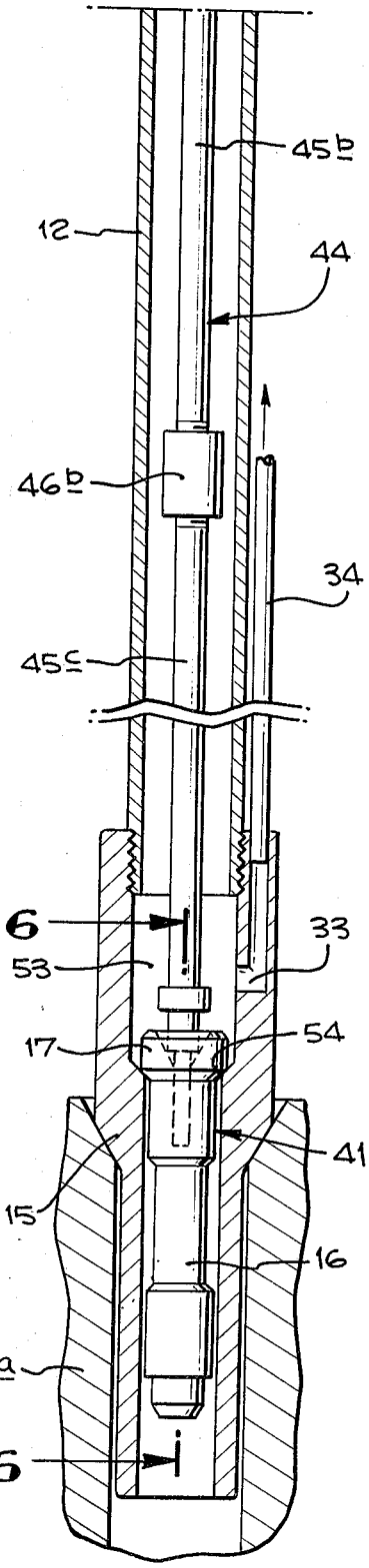
Figure 4:
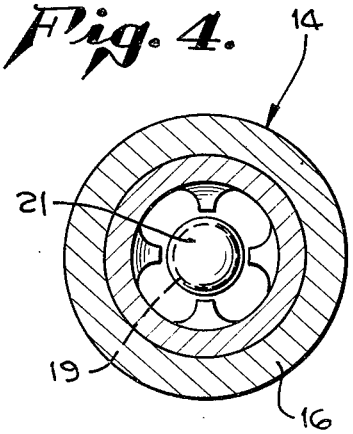
FIG. 4 is an enlarged horizontal section on lines 4—4 of FIG. 3.
Figure 6:
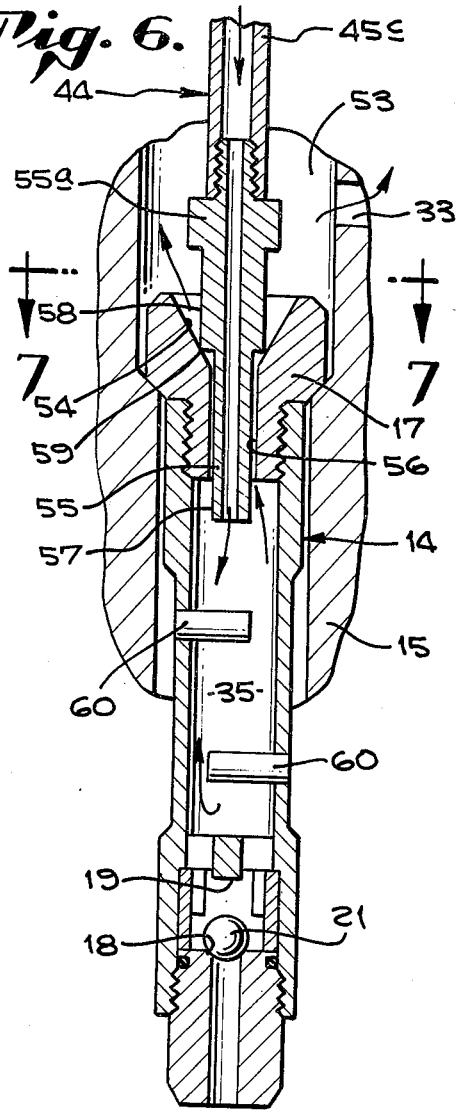

FIGS. 5*a* and 5*b* are vertical sections showing the wash-out tool cooperating in its relation with the standing valve;

FIG. 6 is an enlarged vertical elevation on lines 6—6 of FIG. 5*b;*

Figure 8:
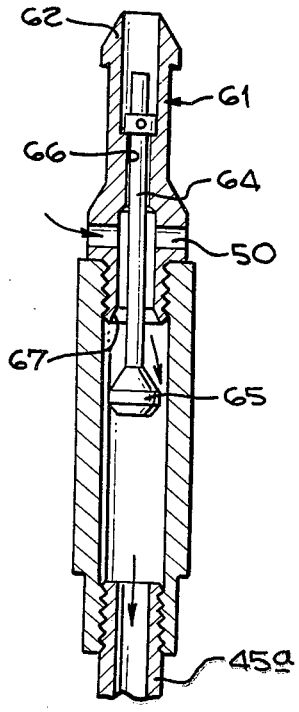
Figure 7:
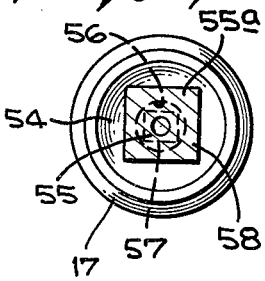

FIG. 7 is a horizontal section taken on lines 7—7 of FIG. 6;

FIG. 8 is an enlarged vertical section taken on lines 8—8 of FIG. 5*a;*

Figure 10:
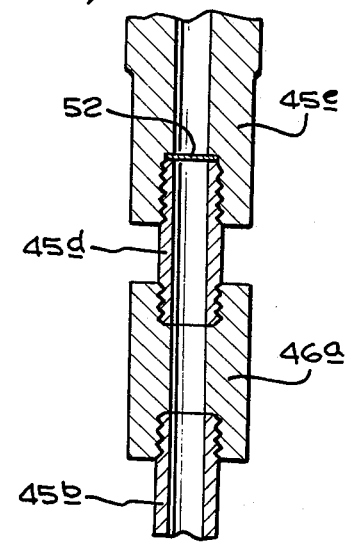
Figure 9:
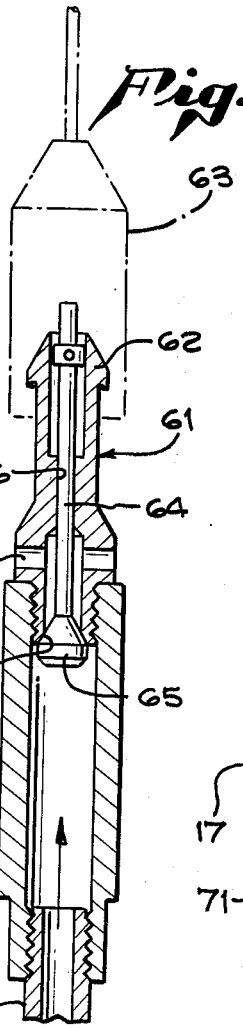

FIG. 9 is a vertical section similar to that showing in FIG. 8, but illustrating wire line retrieval of the wash-out tool;

FIG. 10 is an enlarged vertical section taken on lines 10—10 of FIG. 5*a;*

Figure 11:
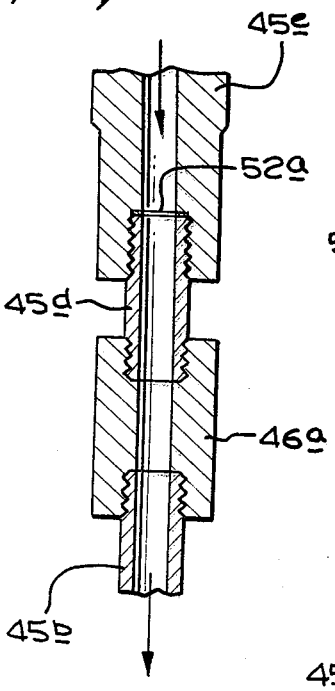
Figure 12:
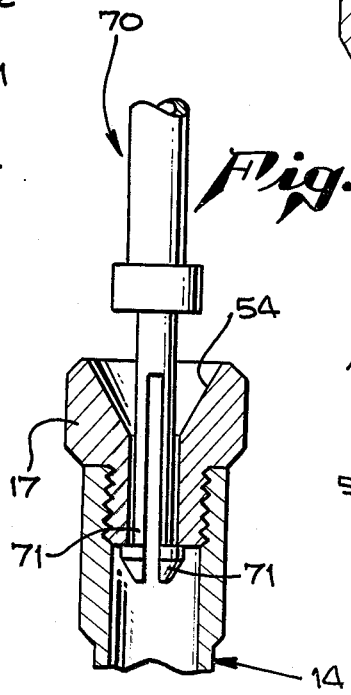

FIG. 11 is a view like FIG. 10, but showing the flow blocking disc in ruptured condition;

FIG. 12 is a vertical elevation showing standing valve retrieval.

DETAILED DESCRIPTION

Figure 1:
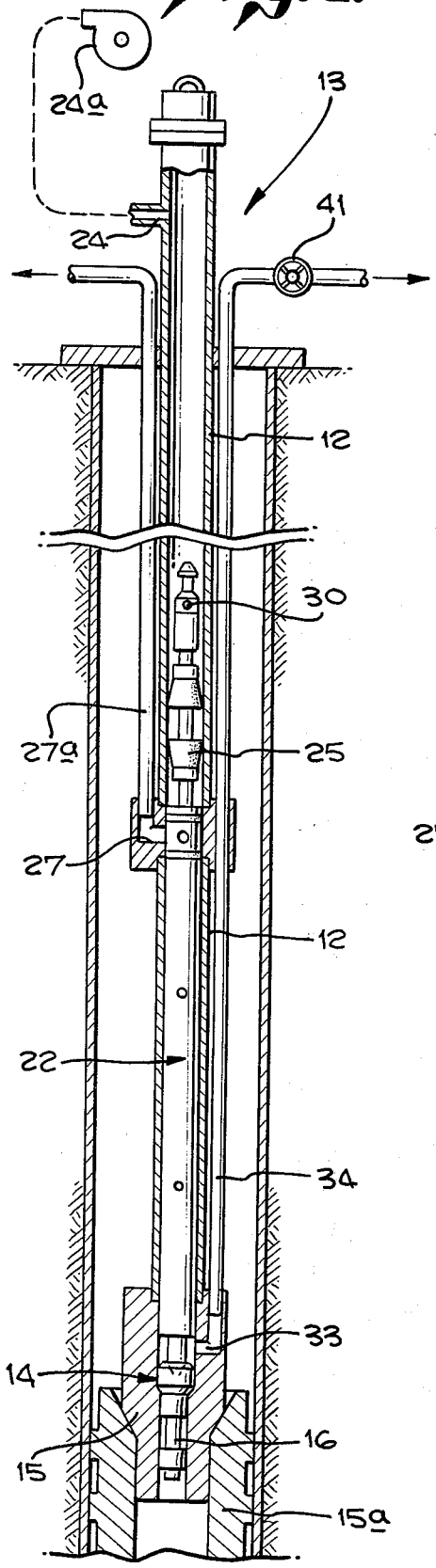
Figure 3:
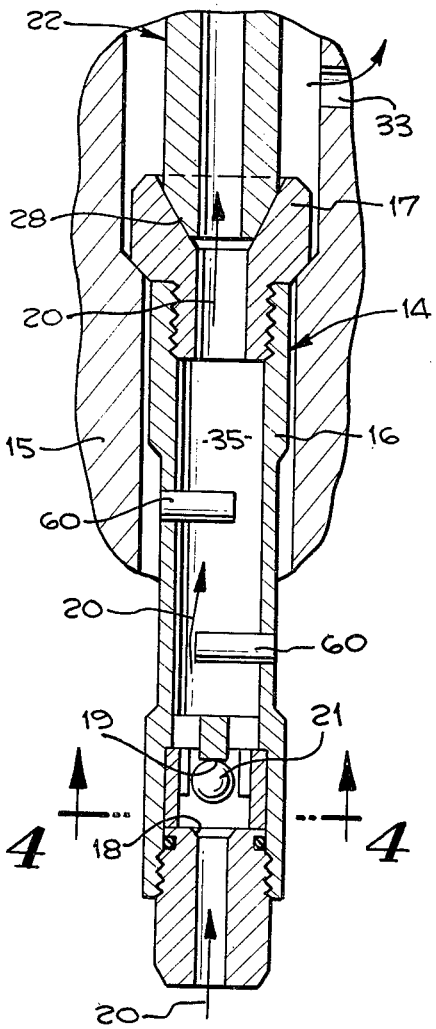
FIG. 3 is an enlarged vertical section on lines 3—3 of FIG. 2*b;*

Referring first to FIG. 1, a well 10, cased at 11, contains well tubing 12 extending from the well head 13 to a standing valve 14. The valve is suitably supported by tubular member 15 connected with the string, member 15 being supported at 15*a* in the well. As better shown in FIG. 3, the valve includes a tubular body 16 having an upwardly flaring mouthpiece 17, and a steel valve ball 21 movable between a lower seat 18 and an upper stop 19, which may be magnetic. With the ball engaging or attracted to the stop, well production fluid flows upwardly as indicated by arrows 20, within the valve body past the ball 21 and upwardly through mouthpiece 17. When seated at 18, the ball blocks downward flow within the body.

Figure 2A:
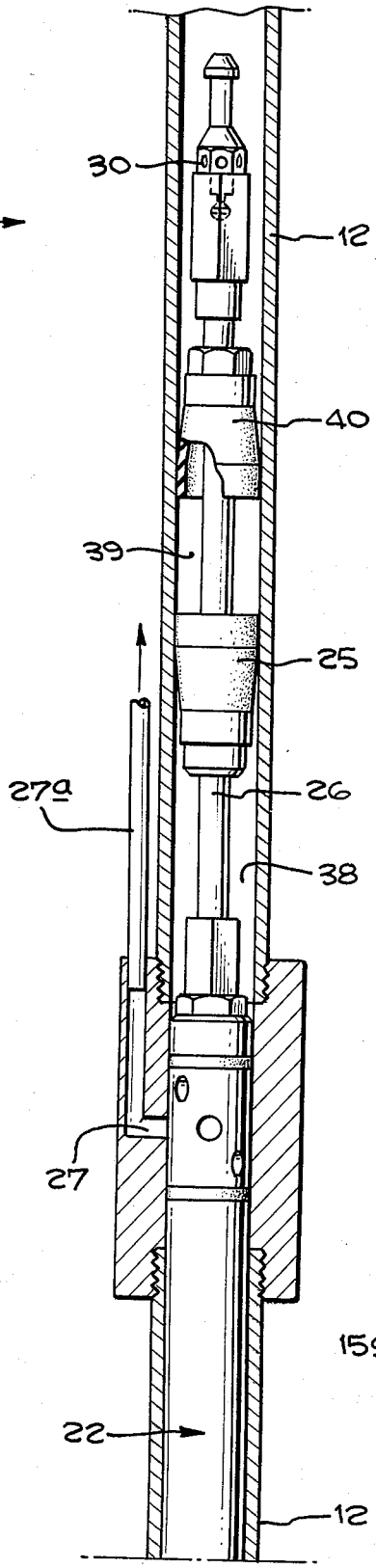
Figure 2B:
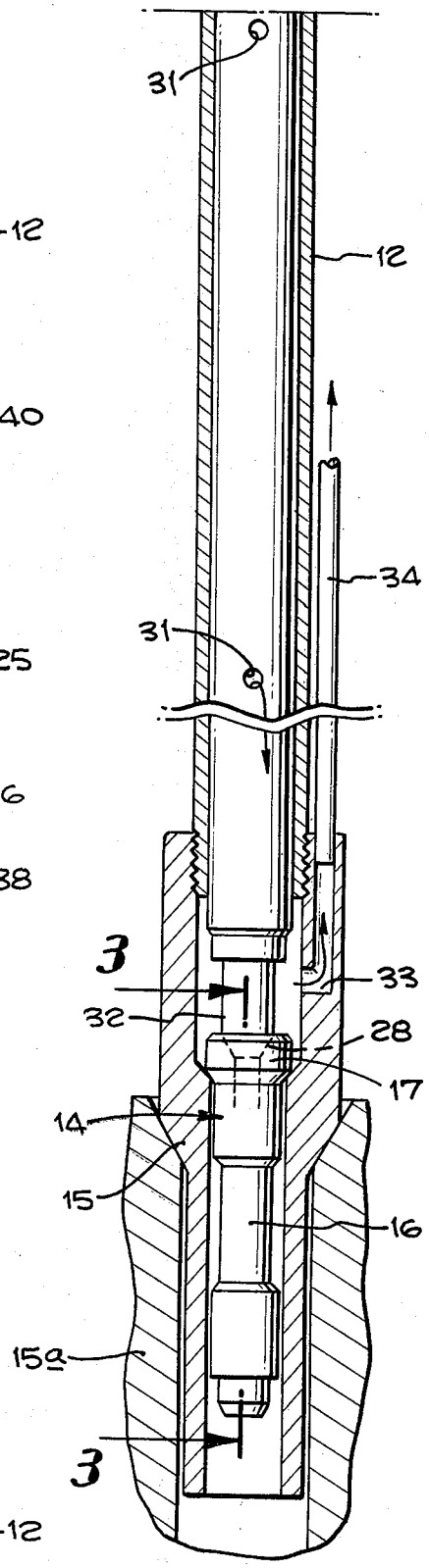

FIGS. 1 and 2 show a free pump unit 22 in position seated on the mouthpiece 17, the pump having been traveled downwardly within the tubing from the well head 13. In this regard, the pump 22 may be forced down the tubing as by pressure of fluid introduced into the tubing at 24 from surface pump 24*a*, the pressure exerted against upwardly flaring cup 25 on the tubular body 26 of the free pump. During this time, the standing valve is closed (ball 21 is seated at 18), and fluid in the tubing below the free pump is forced outwardly via port 27 and upwardly within a vertical return line 27*a*, and to the surface. Note the pump tubular lower terminal 28 seated on the mouthpiece of the standing valve, to receive production fluid.

The pump is reciprocated in response to power fluid pumped downwardly in the tubing, as from source 24*a*, such fluid entering the pump body upper inlet 30, and exiting via outlet ports 31. Such pumps are known, and are products of Kobe Company, Huntington Park, Calif. Operation of the pump causes upward production of well fluid into the pump lower extent 32, and then lateral flow through a side port 33 in the tubing to flow upward in auxiliary line or tubing 34. Power fluid exiting from ports 31 also mixes with the production fluid and rises to the surface therewith.

Operation of the pump and upward flow of production fluid often results in sanding of the standing valve, particularly in interior area 35 above the ball, with consequent malfunctioning and decreased production of well fluid. The tubing must then be pulled for cleaning of the valve, with consequent loss of production time and costly service time.

The present invention makes possible sub-surface wash-out of sand from the valve, after the pump 22 is first removed from the well. For this purpose, pressure fluid is introduced from pump 24*a* to line 27*a*, and downwardly via port 27 to the interior of the tubing. Such pressure is exerted upwardly within zone 38 past cup 25 and into zone 39 beneath downwardly flaring cup 40, thereby lifting the pump in the tubing to the surface for retrieval. During this time, a valve 41 in line 34 may be closed.

Thereafter, a wash-out tool 44 is traveled downwardly in the tubing and landed on the standing valve, as better seen in FIGS. 5*a*, 5*b* and 6. The tool is typically shown to include a vertically elongated tubular body 45 comprising sections 45*a*–45*c* interconnected as by joints 46*a* and 46*b*, there being elastomer cup means on the body to engage the tubing bore 12*a* as the body travels lengthwise in the bore. For example, the cup means may include an upper cup 47 flaring downwardly, and lower cups 48 and 49 flaring upwardly. The latter receive fluid pressure introduced into the tubing as via inlet 24 to "pump" the tool downwardly to landed location, exhausting fluid in the tubing then flowing upwardly in line 27*a*, as described. Conversely, when the tool is to be upwardly retrieved, pressure fluid is introduced via line 27*a* to the tubing flow the downflaring cup 40, and exhausting fluid above the rising tool exits via outlet 24.

The tool body has a fluid pressure inlet or inlets 50 above the cup means to admit downwardly exerted pressure fluid to the body interior; however, such fluid is initially blocked against flow downwardly through the tool as by a frangible or rupturable plug such as disc 52, better seen in FIG. 5*a*. This allows down-pumping of the tool as described. When the tool is landed, as by engagement of a shoulder 59 on or near the tool lower end with standing valve mouthpiece taper 54, fluid pressure is allowed to build up in the tubing and above the disc in the tool, for ultimately rupturing the disc. Pressure fluid then surges past the disc and downwardly through the tubular projection stem 55, as seen in FIG. 6, to entrain sand in space 35, elevating such sand through the mouthpiece bore 56 into region 53 in the tubing above the mouthpiece. The entrained sand then flows outwardly via port 33 to be elevated to the surface in the upward flow within pipe 34. Side flats 57 formed by the polygonal (as for example square) cross-section stem 55 form clearances between the flats and annular bore 56 to pass the flow entrained sand upwardly. Note ball 21 remains seated during such flushing. Also, side flats are formed at 58 on a larger polygonal cross-section stem section 55*a* immediately above stem 55, to aid upward flow past flared mouth 54. Shoulder 59 is formed between stem 55 and section 55*a* to land on the flared mouth, as seen in FIG. 6.

Knock-out pins 60 within region 35 tend to enhance sand collection in that region during the pumping phase as described above, such pins being employed in standing valves.

Following flushing of sand as described, the tool is elevated and retrieved, as described, and the pump 22 is again traveled downwardly to FIGS. 1 and 2 position, to resume pumping the well.

FIG. 8 shows an upward projection 61 at the upper end of the tool, providing a head or flange 62 adapted to be grasped by a wire line suspended tool retrieval means, as indicated at 63 in FIG. 9. Such retrieval offers an alternative to the "pumping" retrieval described above. The projection contains a valve stem 64 having a valve plug 65 at the lower end thereof. The stem is reciprocable in the bore 66 of the projection, so that upward flow pressure against plug 65 elevates the latter to seat at 67, as shown in FIG. 9, preventing loss of pressure fluid during upward pumping retrieval of the tool. The plug is in down position, as shown in FIG. 8, during downward introduction of fluid pressure via ports 50 for sand flushing as described.

FIG. 10 shows disc 52 carried by a reduced diameter sub-section 45*d* of the body threadably connected with joint 46*a*, that section also threadably connected into a larger diameter section 45*e* of the body. FIG. 11 shows the disc in ruptured condition, forming an opening 52*a* therethrough.

FIG. 12 shows a retrieval tool 70 having spreadable fingers 71 inserted into the standing valve to elevate and retrieve it upwardly. Tool 70 may be connected with the tool 44, at the lower end thereof.

We claim:

1. In a standing valve wash-out tool adapted to be landed on sand containing means, a. a vertically elongated tubular body, b. elastomer cup means on the body to engage a well tubing bore as the body travels lengthwise within said bore in response to fluid pressure exertion on the cup means exteriorly of the body, c. the body having a fluid pressure inlet above the cup means, there being a frangible plug within the body blocking fluid pressure flow downwardly through the body, d. a seat on the body proximate the lower end thereof to land on said sand containing means, whereby application of sufficient fluid pressure within the body will rupture said plug and pass downwardly through the body and outwardly below said seat to wash sand from said sand containing means, and e. said body including a reduced cross-section lower projection extending below said seat to penetrate said sand containing means for conducting pressure fluid thereinto.

2. The tool of claim 1 wherein said cup means include vertically spaced cups, upper cup means flaring downwardly and lower cup means flaring upwardly.

3. The tool of claim 1 wherein said reduced cross-section lower projection has exterior side flats.

4. In a standing valve wash-out tool adapted to be landed on sand containing means, a. a vertically elongated tubular body, b. elastomer cup means on the body to engage a well tubing bore as the body travels lengthwise within said bore in response to fluid pressure exertion on the cup means exteriorly of the body, c. the body having a fluid pressure inlet above the cup means, there being a frangible plug within the body blocking fluid pressure flow downwardly through the body, d. a seat on the body proximate the lower end thereof to land on said sand containing means, whereby application of sufficient fluid pressure within the body will rupture said plug and pass downwardly through the body and outwardly below said seat to wash sand from said sand containing means, e. and including said sand containing means which comprises a standing valve body which is tubular and has a downwardly and radially inwardly tapering upwardly facing mouth landing said seat.

5. The tool of claim 4 including said well tubing in which said tool is received, said tubing supporting said standing valve.

6. The tool of claim 5 including an upward projection at the upper end of the tool and integral therewith, said projection having a head adapted to be grasped by wire line suspended tool retrieval means.

7. The tool of claim 6 including said retrieval means grasping said head.

8. The tool of claim 5 including first auxiliary tubing extending vertically alongside said well tubing and communicating with the interior thereof at a first side location above the level of said seat but below the levels of said cups, for receiving sand displaced by said tool.

9. The tool of claim 8 including second auxiliary tubing extending vertically alongside said well tubing and communicating with the interior thereof at second side location above the level of said first side location but below the levels of said cups.

10. The tool of claim 4 having a polygonal cross-section tubular stem received into the standing valve body and forming therewith sand escape clearance.

11. In a standing valve wash-out tool adapted to be landed on sand containing means, a. a vertically elongated tubular body, b. elastomer cup means on the body to engage a well tubing bore as the body travels lengthwise within said bore in response to fluid pressure exertion on the cup means exteriorly of the body, c. the body having a fluid pressure inlet above the cup means, there being a frangible plug within the body blocking fluid pressure flow downwardly through the body, d. a seat on the body proximate the lower end thereof to land on said sand containing means, whereby application of sufficient fluid pressure within the body will rupture said plug and pass downwardly through the body and outwardly below said seat to wash sand from said sand containing means, e. and including a flow responsive control valve carried by the body to pass inward flow into the body via said inlet and to block outward flow from within the body through the inlet.

12. In a standing valve wash-out tool adapted to be landed on sand containing means, a. a vertically elongated tubular body, b. elastomer cup means on the body to engage a well tubing bore as the body travels lengthwise within said bore in response to fluid pressure exertion on the cup means exteriorly of the body, c. the body having a fluid pressure inlet above the cup means, there being a frangible plug within the body blocking fluid pressure flow downwardly through the body, d. a seat on the body proximate the lower end thereof to land on said sand containing means, whereby application of sufficient fluid pressure within the body will rupture said plug and pass downwardly through the body and outwardly below said seat to wash sand from said sand containing means, e. and including valve retrieval means connected with the tool body to project therebelow.

13. The method of operating a well containing tubing and a sub-surface standing valve and employing a pump and a wash-out tool containing a rupturable disc, the steps that include a. traveling the pump downwardly in the tubing, landing the pump on the standing valve; and pumping fluid down the tubing to operate the pump, said operation resulting in upward production of well fluid through the standing valve and upwardly in the well outside the tubing and above the level of the pump, said operating also resulting in sand accumulation in the standing valve, b. traveling the pump upwardly in the tubing and retrieving the pump at the surface, c. traveling the wash-out tool downwardly in the tubing and landing the tool on the standing valve, d. pumping fluid downwardly in the tubing to build up fluid pressure in the standing valve, thereby to rupture the disc, and thereafter pumping fluid downwardly through the tool to wash sand from the standing valve, e. traveling the tool upwardly in the tubing and retrieving the tool at the surface, and f. again traveling the pump downwardly in the tubing, landing the pump on the valve and operating the pump as aforesaid.

* * * * *